US005468000A

United States Patent [19]

Bennett

[11] Patent Number: 5,468,000

[45] Date of Patent: Nov. 21, 1995

[54] REMOTELY ACTIVATED LOCATION IDENTIFYING ARROW ATTACHMENT

[76] Inventor: Tommy L. Bennett, Rte. 3, Box 4032, Palatka, Fla. 32177

[21] Appl. No.: 421,302

[22] Filed: Apr. 13, 1995

[51] Int. Cl.[6] ..... F42B 6/04

[52] U.S. Cl. ..... 273/416

[58] Field of Search ..... 273/416, 418, 273/213

[56] References Cited

U.S. PATENT DOCUMENTS

| | | | |
|---|---|---|---|
| 3,150,875 | 9/1964 | Searles | 273/418 |
| 3,790,948 | 2/1974 | Ratkovich | 273/416 X |
| 4,340,930 | 7/1982 | Carissimi | 273/416 X |
| 4,421,319 | 12/1983 | Murphy | 273/416 |
| 4,660,089 | 4/1987 | Barricks et al. | 273/213 X |
| 4,675,683 | 6/1987 | Robinson et al. | 273/416 X |
| 4,885,800 | 12/1989 | Ragle | 273/416 X |
| 4,951,952 | 8/1990 | Saddler | 273/416 |
| 5,134,552 | 7/1992 | Call et al. | 273/416 X |
| 5,251,907 | 10/1993 | Ady | 273/416 |
| 5,294,131 | 3/1994 | Manske | 273/416 |

FOREIGN PATENT DOCUMENTS

| | | | |
|---|---|---|---|
| 650643 | 10/1991 | Australia | 273/213 |
| 3609016 | 9/1987 | Germany | 273/213 |

*Primary Examiner*—Paul E. Shapiro

[57] ABSTRACT

An attachment for facilitating audible identification of a location of an arrow. The inventive device includes a receiver assembly coupled to the arrow between the shaft and the knock thereof for selectively generating an audio signal. A transmitter assembly positioned remotely relative to the receiver assembly operates for generating a signal to activate the receiver assembly to facilitate audible location of the associated arrow.

5 Claims, 3 Drawing Sheets

REMOTELY ACTIVATED LOCATION IDENTIFYING ARROW ATTACHMENT

BACKGROUND OF THE INVENTION

1. Field of the Invention

The present invention relates to projectile locators and more particularly pertains to an remotely activated location identifying arrow attachment for facilitating audible location of an arrow.

2. Description of the Prior Art

The use of projectile locators is known in the prior art. More specifically, projectile locators heretofore devised and utilized are known to consist basically of familiar, expected and obvious structural configurations, notwithstanding the myriad of designs encompassed by the crowded prior art which have been developed for the fulfillment of countless objectives and requirements.

Known prior art projectile locators include U.S. Pat. Nos. 3,790,948; 4,858,935; 5,024,447; 5,141,229; 5,157,405; and 5,167,417.

While these devices fulfill their respective, particular objectives and requirements, the aforementioned patents do not disclose a remotely activated location identifying arrow attachment for facilitating audible identification of a location of an arrow which includes a receiver assembly couplable to an arrow between the shaft and the knock thereof for selectively generating an audio signal, and a transmitter assembly positioned remotely relative to the receiver assembly for generating a signal to activate the receiver assembly to facilitate audible location of the associated arrow.

In these respects, the remotely activated location identifying arrow attachment according to the present invention substantially departs from the conventional concepts and designs of the prior art, and in so doing provides an apparatus primarily developed for the purpose of facilitating audible location of an arrow.

SUMMARY OF THE INVENTION

In view of the foregoing disadvantages inherent in the known types of projectile locators now present in the prior art, the present invention provides a new remotely activated location identifying arrow attachment construction wherein the same can be utilized for facilitating audible location of an arrow. As such, the general purpose of the present invention, which will be described subsequently in greater detail, is to provide a new remotely activated location identifying arrow attachment apparatus and method which has many of the advantages of the projectile locators mentioned heretofore and many novel features that result in a remotely activated location identifying arrow attachment which is not anticipated, rendered obvious, suggested, or even implied by any of the prior art projectile locators, either alone or in any combination thereof.

To attain this, the present invention generally comprises an attachment for facilitating audible identification of a location of an arrow. The inventive device includes a receiver assembly coupled to the arrow between the shaft and the knock thereof for selectively generating an audio signal. A transmitter assembly positioned remotely relative to the receiver assembly operates for generating a signal to activate the receiver assembly to facilitate audible location of the associated arrow.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new remotely activated location identifying arrow attachment apparatus and method which has many of the advantages of the projectile locators mentioned heretofore and many novel features that result in a remotely activated location identifying arrow attachment which is not anticipated, rendered obvious, suggested, or even implied by any of the prior art projectile locators, either alone or in any combination thereof.

It is another object of the present invention to provide a new remotely activated location identifying arrow attachment which may be easily and efficiently manufactured and marketed.

It is a further object of the present invention to provide a new remotely activated location identifying arrow attachment which is of a durable and reliable construction.

An even further object of the present invention is to provide a new remotely activated location identifying arrow attachment which is susceptible of a low cost of manufacture with regard to both materials and labor, and which accordingly is then susceptible of low prices of sale to the consuming public, thereby making such remotely activated location identifying arrow attachments economically available to the buying public.

Still yet another object of the present invention is to provide a new remotely activated location identifying arrow attachment which provides in the apparatuses and methods of the prior art some of the advantages thereof, while simultaneously overcoming some of the disadvantages normally associated therewith.

Still another object of the present invention is to provide a new remotely activated location identifying arrow attachment for facilitating audible location of an arrow.

Yet another object of the present invention is to provide a new remotely activated location identifying arrow attachment which includes a receiver assembly couplable to an arrow between the shaft and the knock thereof for selectively generating an audio signal, and a transmitter assembly positioned remotely relative to the receiver assembly for generating a signal to activate the receiver assembly to facilitate audible location of the associated arrow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
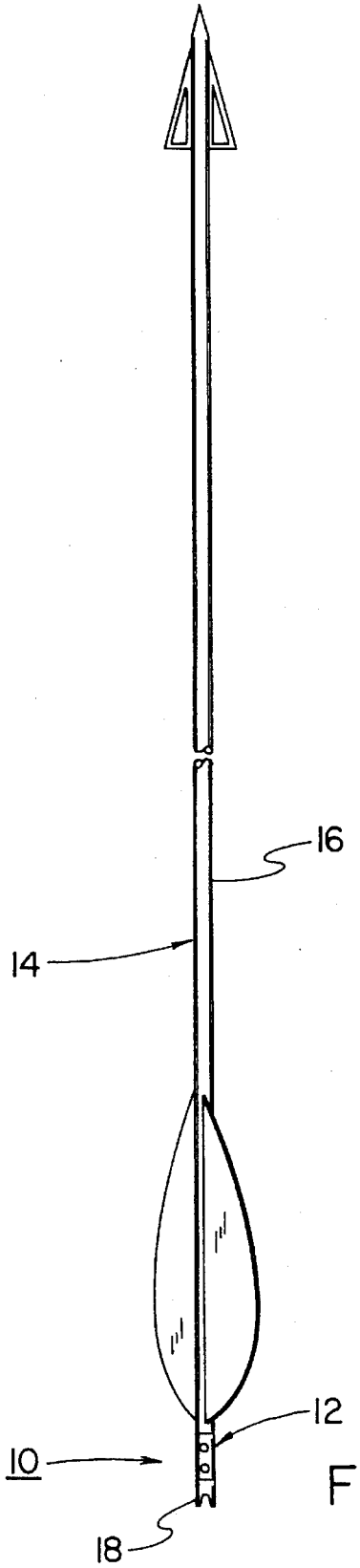
FIG. 1 is a front elevation view of a remotely activated location identifying arrow attachment according to the present invention as coupled to an arrow.

With reference now to the drawings, and in particular to FIGS. 1–7 thereof, a new remotely activated location identifying arrow attachment embodying the principles and concepts of the present invention and generally designated by the reference numeral 10 will be described.

Figure 2:
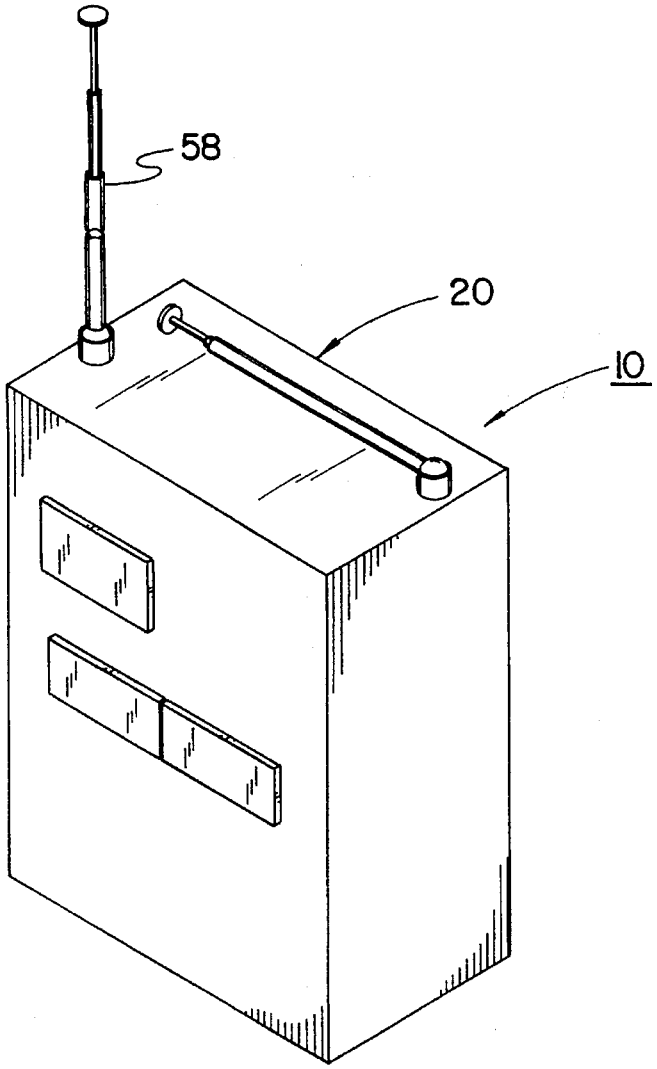
FIG. 2 is an isometric illustration of a transmitter means comprising a further portion of the invention.
Figure 3:
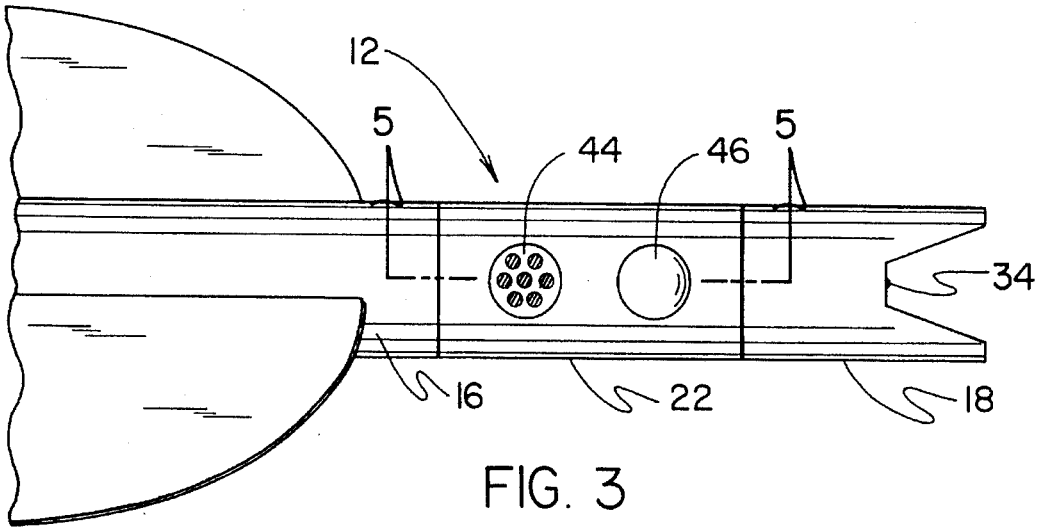
FIG. 3 is an enlarged front elevation view of the invention coupled with an arrow.

More specifically, it will be noted that the remotely activated location identifying arrow attachment 10 comprises a receiver means 12 for coupling to an arrow 14 between an arrow shaft 16 and a nock 18 thereof and for selectively generating an audio signal. A transmitter means 20, as shown in FIG. 2, is also provided as part of the present invention 10 for generating a signal to activate the receiver means 12. By this structure, the receiver means 12 can be remotely activated by the transmitter means 20 to facilitate audible identification of a location of the arrow subsequent to shooting thereof.

As best illustrated in FIGS. 3 through 6, it can be shown that the receiver means 12 according to the present invention 10 preferably comprises a cylindrical main body 22 having an arrow mounting projection 24 extending from a first end thereof, and a nock mounting projecting 26 extending from a second end thereof. The mounting projections 24 and 26 are provided with exterior threads which cooperate with a threaded interior 28 of the arrow shaft 16, and an unlabeled threaded interior of the nock 18, respectively, to couple the cylindrical main body 22 therebetween.

Figure 4:
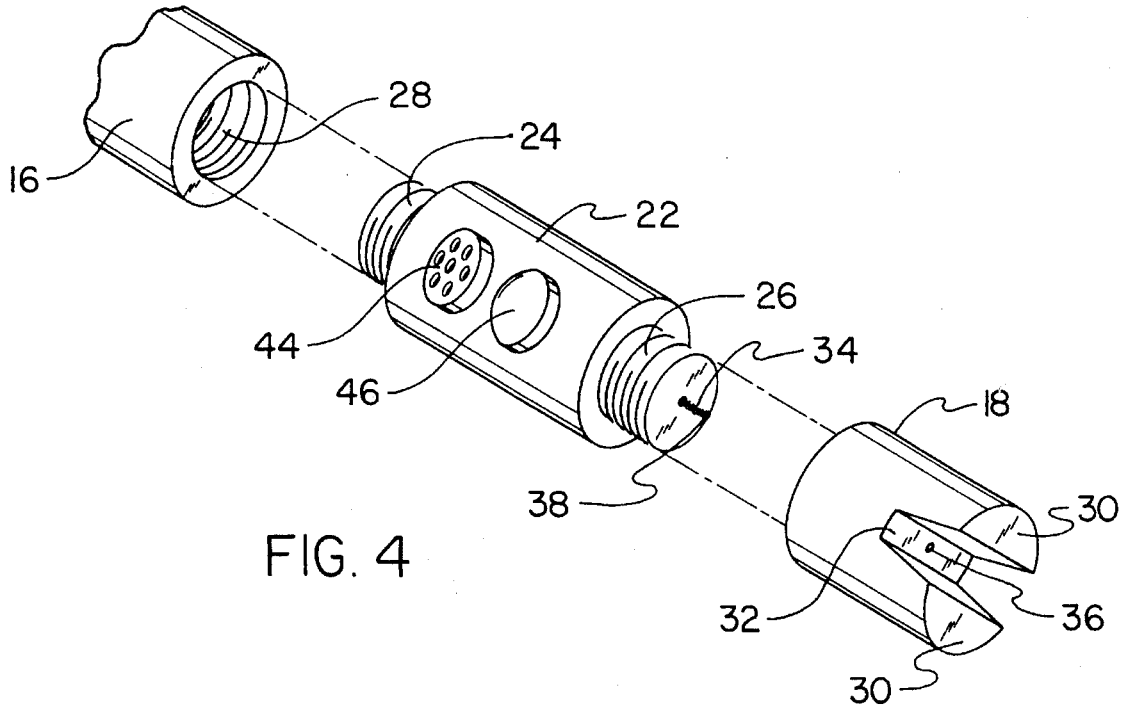
FIG. 4 is an exploded isometric illustration detailing a coupling of the invention to an arrow.
Figure 5:
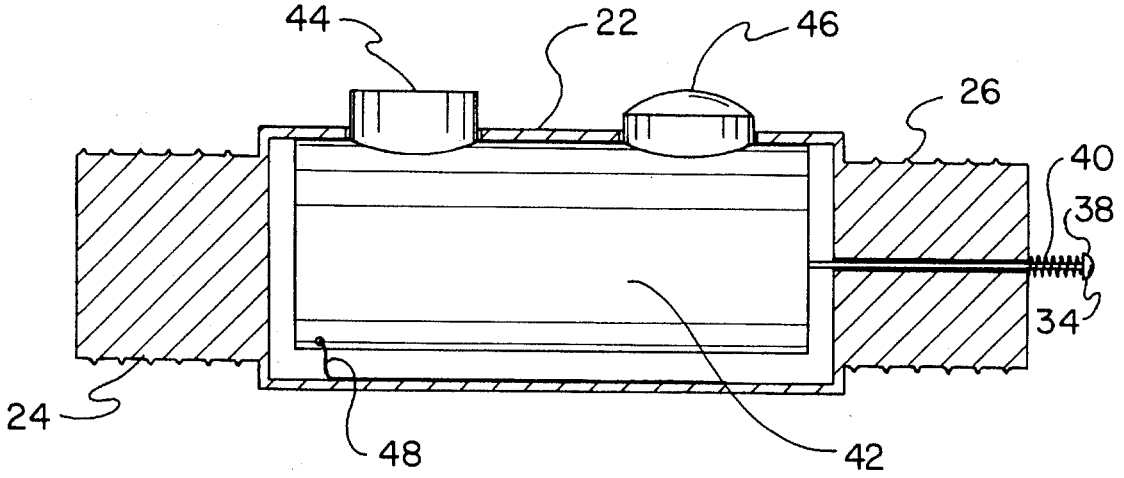
FIG. 5 is a cross sectional view taken along line 5—5 of FIG. 3.

As best illustrated in FIG. 4, it can be shown that the nock 18 according to the present invention is shaped so as to define a pair of spaced furcations 30 between which an unillustrated arrow string is received during shooting of the arrow 14 in a conventionally known manner. A connecting panel 32 extends between the spaced furcations 30 of the nock 18 and receives a force of the string during acceleration of the arrow 14 from the unillustrated bow. To conserve electrical power and activate the receiver means 12 only after shooting of the arrow 14 from the bow, an actuating switch 34 extends through an aperture 36 in the connecting panel 32, whereby a shooting or acceleration of the arrow 14 from the bow will depress the actuating switch 34 to energize the receiver means 12. As shown in FIGS. 4 and 5, the actuating switch 34 includes a plunger 38 which projects through the aperture 36 in the connecting panel 32 of the nock 18. A spring 40 is concentrically positioned about the plunger 38 and operates to maintain the plunger in an extended position, whereby only through a force of the string against the plunger 38 during acceleration of the arrow 14 from the bow will the actuating switch 34 be depressed to energizer the receiver means 12.

Figure 6:
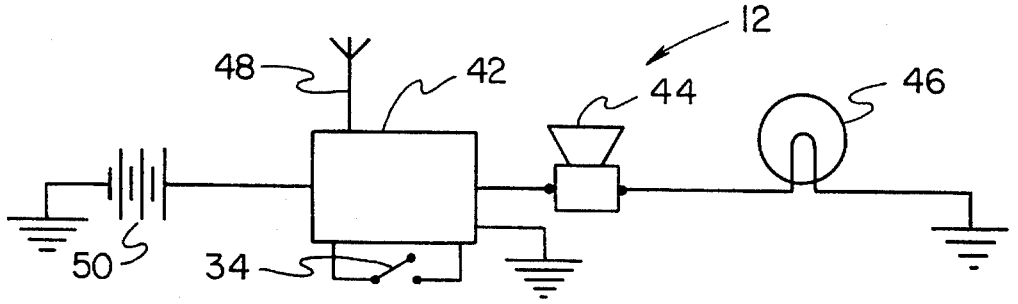
FIG. 6 is a diagrammatic circuitry illustration of a portion of the receiver means of the present invention.

As shown in the cross section illustration of FIG. 5, the receiver means 12 includes within the cylindrical main body 22 thereof a battery powered signal receiving means 42 for receiving a radio frequency signal or the like generated by the transmitter means 20. A beeper 44 is mounted exteriorly of the cylindrical main body 22 and communicates with the signal receiving means 42. Similarly an indicator light 46 mounted along an exterior of the cylindrical main body 22 also electrically communicates with the signal receiving means 42, whereby both the indicator light and the beeper can be selectively energized by the signal receiving means 42 to effect audible and visual identification of the associated arrow 14 to which the device 10 is attached. An antenna 48 extends along an interior of the cylindrical main body 22 and communicates with the signal receiving means 42 to receive a radio frequency signal generated by the transmitter means 20. As shown in FIG. 6, the signal receiving means 42 is in electrical communication with a battery 50 providing the necessary electrical power for operation of the signal receiving means as well as the beeper 44 and the indicator light 46.

Figure 7:
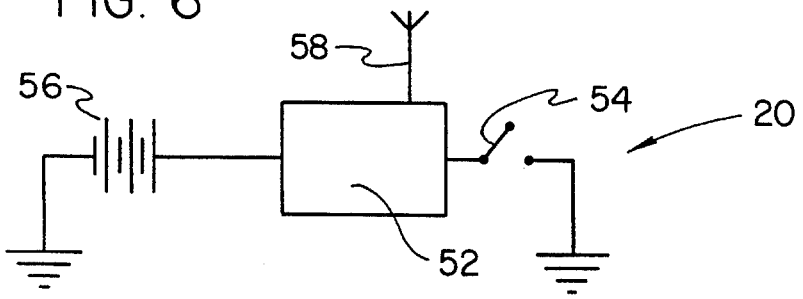
FIG. 7 is a diagrammatic circuitry illustration of a portion of the transmitter means of the invention.

As shown in FIG. 7, the transmitter means 20 includes a signal transmitting means 52 for generating a radio frequency signal to activate the receiver means 12 as described above. A transmitting switch 54 can be selectively activated to energize the signal transmitting means 52 as desired. A battery 56 in electrical communication with the signal transmitting means 52 provides the necessary electrical energy to generate a radio frequency signal radiated through a transmitting antenna 58 electrically coupled thereto.

Any conventionally known circuitry may be utilized for the signal receiving means 42 and the signal transmitting means 52 which can function as described above for activating the beeper 44 and the indicator light 46 from a remote location. To this end, examples of suitable circuitry can be found within U.S. Pat. Nos. 3,709,948, 5,141,229, 4,858,935, and 4,101,873 all of which are incorporated herein by reference.

In use, the remotely activated location identifying arrow attachment 10 can be easily coupled to an arrow 14 between the arrow shaft and nock 18 thereof. Upon shooting of the arrow 14, the actuating switch 34 will be depressed by a force of the string of the bow accelerating the arrow 14 therefrom which will energize the signal receiving means 42 of the receiver means 12 for a predetermined length of time. The transmitter means 20 can then be utilized by an individual to effect remote actuation of the beeper 44 and the indicator light 46 of the receiver means 12 to facilitate audible and visual identification of the location of the arrow 14 to which the device 10 is attached.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A remotely activated location identifying arrow attachment comprising:

a receiver means for coupling to an arrow between an arrow shaft and a hock thereof and for selectively generating an audio signal; and, a transmitter means for generating a signal to activate the receiver means from a remote location to facilitate audible identification of a location of the arrow subsequent to shooting thereof.

2. The remotely activated location identifying arrow attachment of claim 1, wherein the receiver means is responsive to an acceleration of an arrow to which it is attached, whereby the receiver means will become energized for a predetermined length of time upon acceleration of the associated arrow from a bow.

3. The remotely activated location identifying arrow attachment of claim 2, wherein the receiver means comprises a cylindrical main body having an arrow mounting projection extending from a first end thereof, and a nock mounting projecting extending from a second end thereof, the arrow mounting projection being couplable with an arrow shaft of an arrow, and the nock mounting projection being couplable with a nock of the arrow to couple the cylindrical main body between the arrow shaft and the nock.

4. The remotely activated location identifying arrow attachment of claim 3, wherein the receiver means further comprises an actuating switch for effecting selective energization of the receiver means, the actuating switch being mounted within the cylindrical main body and including a plunger projectable through an aperture in a connecting panel of a nock, and a spring concentrically positioned about the plunger for maintaining the plunger in an extended position, whereby only through a force of a string within the nock against the plunger during acceleration of the arrow from a bow will the actuating switch be depressed to energize the receiver means.

5. The remotely activated location identifying arrow attachment of claim 4, wherein the receiver means includes a battery powered signal receiving means for receiving a radio frequency signal; a beeper in electrical communication with the signal receiving means; and an indicator light in electrical communication with the signal receiving means, whereby both the indicator light and the beeper can be selectively energized by the signal receiving means to effect audible and visual identification of an associated arrow.

* * * * *